United States Patent [19]

Coone et al.

[11] 4,063,421

[45] Dec. 20, 1977

[54] GROUTING SYSTEM AND ARRANGEMENT FOR OFFSHORE STRUCTURE

[75] Inventors: Malcolm G. Coone; Erwin E. Hoffman, both of Houston, Tex.

[73] Assignee: Lynes, Inc., Houston, Tex.

[21] Appl. No.: 603,029

[22] Filed: Aug. 4, 1975

[51] Int. Cl.[2] ..... E02D 5/14

[52] U.S. Cl. ..... 61/102

[58] Field of Search ..... 61/46.5, 46, 54, 53.5, 61/69 R, 53.52, 82, 86-104; 166/187

[56] References Cited

U.S. PATENT DOCUMENTS

| | | | |
|---|---|---|---|
| 2,412,185 | 12/1946 | Weber | 61/54 |
| 3,533,241 | 10/1970 | Bowerman et al. | 61/46.5 |
| 3,564,856 | 2/1971 | Blount et al. | 61/46 |
| 3,630,037 | 12/1971 | Howard | 61/54 |
| 3,702,537 | 11/1972 | Landers | 61/46.5 |
| 3,838,575 | 10/1974 | Clark et al. | 61/53.52 X |
| 3,919,850 | 11/1975 | Coone et al. | 61/82 |

*Primary Examiner*—Dennis L. Taylor

*Attorney, Agent, or Firm*—William C. Norvell, Jr.

[57] ABSTRACT

An inflatable seal is first effected adjacent the lower end of the annular space between a piling and a jacket of a supporting leg of an offshore structure and thereafter grouting material is inserted into the annular space between the jacket and the piling. After the seal has been effected, means trap inflating fluid in the seal adjacent the lower end of the annular space while grouting material is discharged into the space.

11 Claims, 6 Drawing Figures

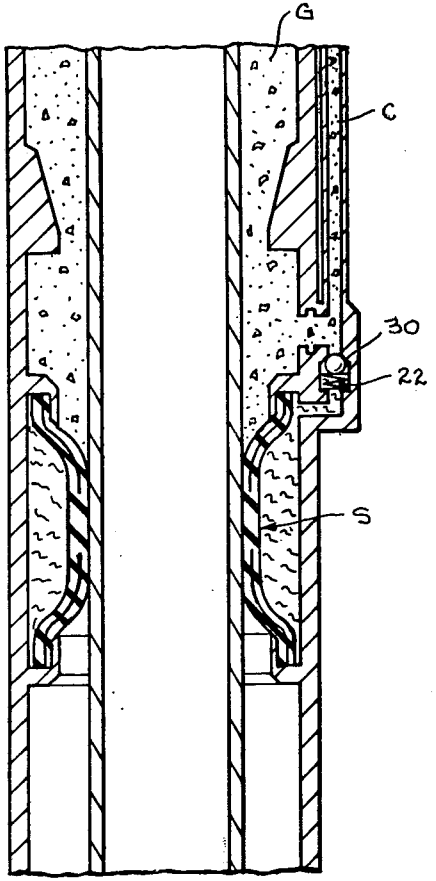
fig.3
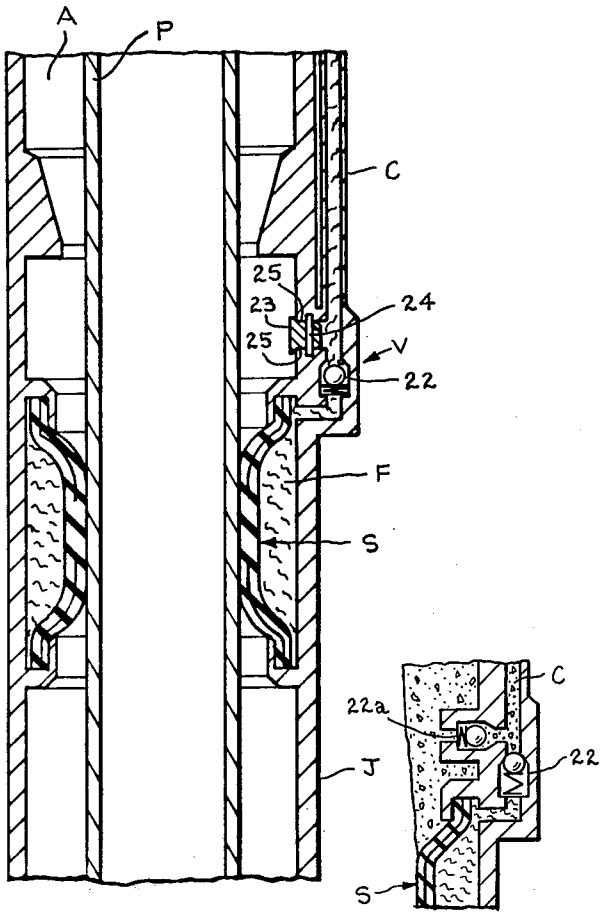
fig.2
fig.2A
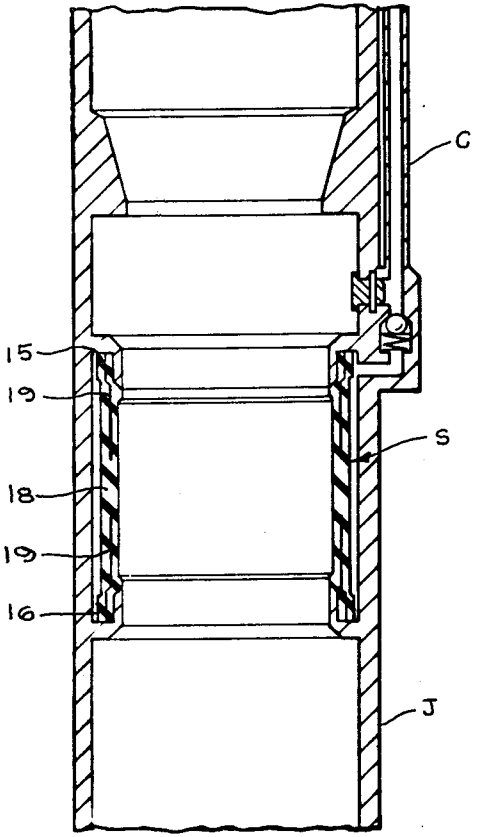
fig.1

GROUTING SYSTEM AND ARRANGEMENT FOR OFFSHORE STRUCTURE

CROSS REFERENCE TO RELATED APPLICATIONS

A specific form of seal means and arrangement is disclosed and claimed in the application of Erwin E. Hoffman, which application is assigned to the assignee of this application, said copending application bearing Ser. No. 603,137, filed on Aug. 4, 1975, for "Seal Arrangement and Flow Control Means Therefor". The present method is also related to the copending application of Malcolm G. Coone assigned to the assignee of this application, said application bearing Ser. No. 465,851, filed May 1, 1974, for "Structure and Method Of Positioning For Use In Water Covered Areas."

SUMMARY OF THE INVENTION

Various types of grouting procedures for the annular space between the jacket and piling of offshore structures have been provided, one of which includes the steps of discharging a compressed fluid medium into the upper end of the space to evacuate the water therefrom and then discharging grouting material into the space while gradually relieving the pressure as the space fills with the grouting material.

It can be appreciated that problems are encountered in endeavoring to properly maintain the pressure to retain the water expelled, and other problems may be encountered in such process.

Other prior procedures are shown in the following patents: U.S. Pat. Nos. 3,601,999, 3,811,289, 3,468,132, 3,570,259, 3,213,629 and 3,832,857.

The present invention provides a method and arrangement wherein a positive seal may be formed between the jacket and the piling to seal off the annular space therebetween adjacent the lower end thereof, and thereafter grouting material may be injected into the annular space to displace the water therefrom as the grouting material fills the space.

Yet a further object of the present invention is to provide a method for grouting the annular space between the jacket and piling of an offshore structure wherein the annular space is first sealed off adjacent its lower end by an expandable sealing means, and after the expandable sealing means has been actuated to seal off the annular space, opening the annular space to receive grouting material therein to fill such annular space while trapping the inflating fluid in the expandable sealing means.

Yet another object of the present invention is to provide an arrangement for grouting the space between the piling and jacket associated with an offshore structure including expandable reinforced seal means positioned adjacent the lower end of the jacket for sealingly engaging with the piling, conduit means for conducting inflating fluid to the seal means and for conducting cement or grouting material to the space, and means for trapping the inflating fluid in the seal means.

Yet another object of the present invention is to provide an arrangement for grouting the space between the piling and jacket associated with an offshore structure including expandable seal means positioned adjacent the lower end of the jacket for sealingly engaging with the piling, means for conducting inflating fluid to and trapping inflating fluid in the seal means, and conduit means for conducting plastic grouting material to the space.

Yet another object of the present invention is to provide an arrangement for grouting the space between the piling and jacket associated with an offshore structure including expandable seal means positioned adjacent the lower end of the jacket for sealingly engaging with the piling, conduit means for conducting inflating fluid to the seal means, conduit means for conducting plastic grouting material to the space and wherein the conduit means for conducting inflating fluid to said seal means is separate from the conduit means which conducts plastic grouting material to the space.

Yet another object of the present invention is to provide a method and an arrangement for grouting the space between the piling and jacket associated with an offshore structure including expanding seal means positioned adjacent the lower end of the jacket for sealingly engaging with the piling, providing conduit means for conducting plastic grouting material to first inflate the seal means and while maintaining the seal means inflated, thereafter utilizing the same conduit means for conducting plastic grouting material to fill the space.

Other objects and advantages of the present invention will become more readily apparent from consideration of the following description and drawings.

BRIEF DESCRIPTION OF THE DRAWINGS

FIG. 1 is a schematic representation illustrating an inflatable seal means positioned on a jacket with conduit means communicated therewith for first inflation of the seal means and thereafter for providing grouting material to the interior of the jacket and to the space between the jacket and piling;

FIG. 2 illustrates the seal means in inflated position and prior to the time that the space between the jacket piling is opened to receive the cement or grouting material;

FIG. 2A is a partial sectional view showing an alternate arrangement of closure means between the space and the conduit means;

FIG. 3 illustrates the method and a form of the apparatus of the present invention showing the annular seal expanded with inflating fluid trapped therein and grouting material filling the space between the jacket and the piling;

DESCRIPTION OF THE PREFERRED EMBODIMENT

Attention is first directed to FIG. 1 of the drawings wherein an annular jacket J is shown which jacket is associated with the supporting leg of an offshore structure in a manner well known in the art. One or more of such jackets may be supported with the legs of the offshore structure, and such details are well known to those skilled in the art. The jacket J is adapted to receive a piling P therein which is of smaller diameter than the jacket to form a space A therebetween. The piling P is normally driven to refusal through the jacket J to provide a means for positioning the offshore structure in a seabed by means of the supporting legs with which the jackets J are associated. After the piling P has been driven into position in the jacket J, it is desirable to grout the space A between the jacket J and piling P.

Seal means referred to generally at S are carried by the jacket J adjacent its lower end, and conduit means referred to at C are provided which extend upwardly above the surface of the water in which the jacket J and piling P along with the offshore structure are positioned for supplying fluid F to first inflate the seal means S as illustrated in FIG. 2 to seal off between the jacket J and piling P in the annular space A. The conduit C includes means referred to generally by the letter V for controlling communication between the conduit C and the annular space A as well as for closing off the seal means S after the inflating fluid F has been inserted therein and the annular space A opened to the conduit C to receive grouting material referred to by the letter G as illustrated in FIG. 3 of the drawings.

Figure 4:
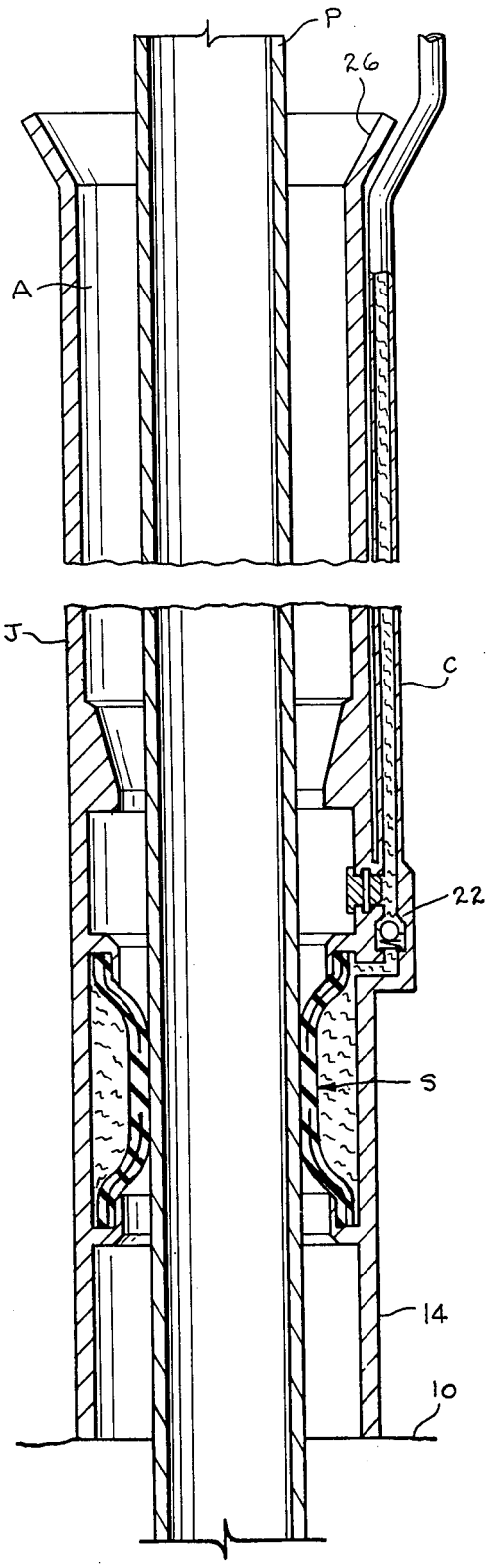
FIG. 4 is a schematic illustration showing a single line or conduit employed for providing inflating fluid to the seal means as well as thereafter employing the same line for supplying grouting material to the annular space.

In the preferred form of the invention, the seal means S is more clearly shown in FIG. 4 as being positioned adjacent the lower end 14 of the jacket J through which the piling P is driven. The lower end of the jacket J is positioned adjacent the seabed 10 as illustrated in FIG. 4 and in some instances it may be sunk in the seabed 10. A specific configuration of the seal means S is described and claimed in the copending application of Erwin E. Hoffman, Ser. No. 603,137, filed on Aug. 4, 1975, hereinbefore referred to as is a specific form of valving arrangement V for closing off communication to the seal means S after the seal has been effected in the annular space as well as providing for communication to the annular space A between the jacket J and piling P.

Prior to the time that the jacket J along with the offshore structure is positioned on the seabed, the seal means S is positioned adjacent the lower end of the jacket J and carried on the interior thereof as illustrated in the drawings. Each end 15 and 16 of the seal means is secured in position on the interior of the jacket J and comprises a reinforced elastomer including an elastomer body 18 with reinforcing therein referred to at 19.

A valve means V is employed in the structure and method of the present invention to control communication between said conduit means C and the seal means S. Such valve means may be of any suitable form and as illustrated comprises a check valve 22. A shear valve means 23 is shown in FIGS. 1 and 2 for closing off opening 25 communicating with space A and conduit C until the pressure in conduit C reaches a predetermined amount.

In FIG. 2A a one-way check valve *22a* is shown in lieu of shear valve means 23. Both it and one-way check valve 22 serve to initially close off the space A and seal means S from the conduit means C until the conduit pressure reaches a predetermined amount. The valve 22 will be set to open at a lower pressure than valve *22a*, and after the seal means S has been inflated with inflating fluid, an increase in pressure actuates valve *22a* or shear valve means 23 whichever form is used to open the conduit means C to space A. Valve 22 then closes due to pressure reduction in conduit means C and the water in space A is evacuated by fluid or by grout. After space A is filled with grout, valve *22a* closes to trap the grouting material in space A.

After the piling P has been driven into position through the jacket J and seal means S, inflating fluid is thereafter supplied normally from above the water level in which the offshore structure is positioned to move the seal means S to sealing position with the piling P as shown in FIG. 2 and thereby close off the lower end of annular space A. When the pressure in the sealing means S reaches a predetermined amount say for example somewhere between 300 to 500 pounds per square inch, by way of example only, the shear pin 24 retaining valve 23 in position will shear by reason of the pressure thereon. When this occurs the valve or plug 23 will be forced out of the opening 25 so that the opening 25 thereafter is communicated with the conduit C for providing grouting material to the annular space as shown in FIG. 3. It can be appreciated that during the foregoing process, the annular space A between the jacket J and piling P is normally filled with water since the upper end 26 of the jacket J is open. The grouting material is injected into this annular space through 25 and forced upwardly from the seal S which is positioned adjacent the lower end of the jacket until all of the water has been displaced by the grout from the annular space A by flowing out the open upper end 26 of the jacket as shown in FIG. 4.

The arrangement of the present invention may be employed when it may be desirable to employ a pressurized fluid to first actuate the seal means S as above described to seal off between the piling P and jacket J as illustrated in FIG. 2 of the drawings. When the pressurized fluid pressure has inflated the seal means S, release of pressure in inflation line 32 permits the check valve 22 to seat as shown at 30 in FIG. 3. When this occurs this closes off the inflating medium within the seal means S to retain it therein.

Thereafter grouting material may be discharged through the conduit C and into the annular space A to fill it. When grouting material G is used as the inflating medium for the seal means S, the check valve 22 will again move to closed position as shown at 30 in FIG. 3 after the shear valve 23 has been actuated to open the annular space A to communicate with the conduit C.

It may be desirable to first evacuate space A with inert fluid before injecting grout, or the grout may be used to displace the water from space A. After the grouting operation is complete valves 22 and *22a* close to prevent backflow from the seal means S and space A to conduit means C.

Figure 5:
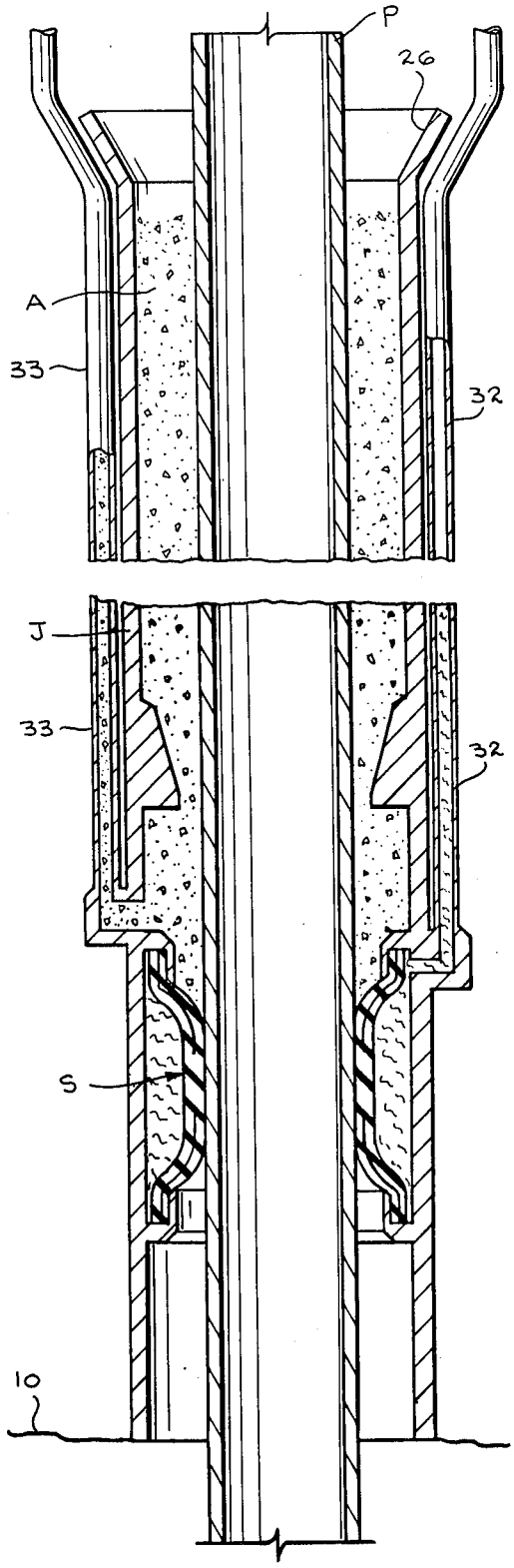
FIG. 5 diagrammatically illustrates an arrangement wherein a separate line is provided for inflating the seal means from that for supplying grouting material to the annular space.

In FIG. 5, a dual conduit system is provided and in this arrangement the jacket J is again illustrated as receiving a piling P, the jacket J having the annular seal means S positioned adjacent the lower end thereof in proximity to the seabed referred to at 10. In this arrangement, a separate line 32 is communicated with the annular seal means S for inflation thereof, and after inflation has been effected, grouting material is injected through the line 33 and into the annular space A to fill such annular space A as previously described. Again the water is expelled out the upper end 26 of the jacket J as the grouting material fills such space between the piling P and the jacket J.

The grouting material may be of any suitable type to accomplish the desired results. It may be plastic, it may be cementitious or any combination of components and constituents which will form a solid mass when it hardens and which will accomplish the desired function under the circumstances as described herein.

The foregoing disclosure and description of the invention are illustrative and explanatory thereof, and various changes in the size, shape, and materials as well as in the details of the illustrated construction may be made without departing from the spirit of the invention.

What is claimed is:

1. A method of grouting an offshore structure positioned on the seabed and having at least one tubular jacket in the water and a piling in the jacket having an outside diameter smaller than the inside diameter of the jacket to thereby form a space between the jacket and piling, said method comprising the steps of:

a. positioning inflatable seal means adjacent the lower end of the jacket;
b. securing conduit means to communicate selectively with the seal means and space;
c. injecting inflating fluid through the conduit means to inflate the seal means inwardly to sealingly engage the piling; and
d. introducing grouting material through the same conduit means and into the space.

2. The method of claim 1 wherein the grouting material is first introduced to the seal means to inflate the seal means into sealing engagement with the piling and the grouting material is thereafter introduced into the space.

3. The method of claim 1 wherein pressurized fluid is first introduced to the seal means to inflate the seal means into the sealing engagement with the piling and grouting material is thereafter introduced into the space.

4. The method of claim 1 wherein pressurized fluid is first introduced to the seal means to inflate the seal means into sealing engagement with the piling and thereafter discharge into the space adjacent the seal means to displace water from the space upon introduction of grouting material into the space.

5. The method of claim 1 including the step of closing off the seal means with the grouting material therein before discharging the grouting material into the space.

6. The method of claim 1 including the step of closing off the seal means with the pressurized fluid therein before discharging the pressurized fluid into the space.

7. The method of claim 1 wherein the water is expelled from the space as the grouting material is introduced thereinto.

8. The method of claim 1 including the steps of closing off the seal means and the space to prevent backflow from the seal means and space through the conduit.

9. The method of claim 1 including the steps of maintaining the seal means inflated at least while the grouting material is discharged into the space.

10. An arrangement for grouting an offshore structure positioned on the sea bed and having at least one tubular jacket in the water and a piling in the jacket having an outside diameter smaller than the inside diameter of the jacket to thereby form a space between the jacket and the piling, said arrangement including:

a. inflatable seal means positioned on the lower end of the jacket for sealingly engaging with the piling;
b. conduit means for conducting inflating fluid to said seal means;
c. conduit means for conducting grouting material to the space;
d. means to communicate said conduit means with the space when the pressure in the conduit means reaches a predetermined amount; and
e. means for closing off the space with the grouting material therein to prevent back flow through said conduit means,
f. said means for closing off the space comprising one-way acting check valve means which remain closed until the pressure in said conduit means reaches a predetermined amount.

11. As arrangement for grouting an offshore structure positioned on the sea bed and having at least one tubular jacket in the water and a piling in the jacket having an outside diameter smaller than the inside diameter of the jacket to thereby form a space between the jacket and the piling, said arrangement including:

a. inflatable seal means positioned on the lower end of the jacket for sealingly engaging with the piling;
b. conduit means for conducting inflating fluid to said seal means;
c. conduit means for conducting grouting material to the space; and
d. means for closing off said seal means with the inflating fluid therein;
e. said means closing off said seal means comprising one-way acting check valve means which remains open until the pressure in said conduit means reaches a predetermined amount and which closes when the pressure in said conduit means falls below such predetermined amount.

* * * * *